US006862765B2

(12) United States Patent
Liou

(10) Patent No.: US 6,862,765 B2
(45) Date of Patent: Mar. 8, 2005

(54) COMBINATION OF TOOL BIT WITH HANDLE

(76) Inventor: Mou-Tang Liou, No.57, Kung Yeh North Road, Nan Kang Industrial Park, Nantou City, Nantou Hsien (TW)

( * ) Notice: Subject to any disclaimer, the term of this patent is extended or adjusted under 35 U.S.C. 154(b) by 0 days.

(21) Appl. No.: 10/264,754

(22) Filed: Oct. 4, 2002

(65) Prior Publication Data

US 2003/0041384 A1 Mar. 6, 2003

Related U.S. Application Data

(63) Continuation-in-part of application No. 09/941,991, filed on Aug. 29, 2001, now Pat. No. 6,612,586.

(51) Int. Cl.[7] ..... B25D 1/02
(52) U.S. Cl. ..... 7/143; 7/145; 81/25
(58) Field of Search ..... 7/143, 145, 167; 81/25, 26, 177.85

(56) References Cited

U.S. PATENT DOCUMENTS

| | | | | | |
|---|---|---|---|---|---|
| 19,111 | A | | 1/1858 | Harrington | 221/196 |
| 1,660,989 | A | * | 2/1928 | Carpenter | 81/124.6 |
| 1,860,998 | A | | 5/1932 | Darazick | 279/76 |
| 2,089,166 | A | | 8/1937 | Reichhardt | 279/30 |
| 2,136,190 | A | | 11/1938 | Gulfelt | 279/76 |
| 2,215,015 | A | | 9/1940 | Richard | 29/242 |
| 2,405,961 | A | | 8/1946 | Lapointe | 279/79 |
| 2,987,334 | A | | 6/1961 | Wendling | 403/8 |
| 3,172,675 | A | | 3/1965 | Gonzalez | 279/2.23 |
| 3,623,173 | A | * | 11/1971 | Hagqvist | 7/145 |
| 3,837,023 | A | * | 9/1974 | Spencer-Foote | 7/145 |
| 4,858,939 | A | | 8/1989 | Riggs | 279/75 |
| 4,962,073 | A | | 10/1990 | Martin et al. | 502/4 |
| 5,255,575 | A | * | 10/1993 | Williams | 81/25 |
| 5,398,946 | A | | 3/1995 | Quiring | 279/30 |
| 5,685,208 | A | * | 11/1997 | Tidwell | 81/177.85 |
| 5,934,384 | A | | 8/1999 | Wang | 173/132 |
| 6,023,997 | A | * | 2/2000 | Willis et al. | 81/25 |
| 6,270,085 | B1 | | 8/2001 | Chen et al. | 279/22 |
| 6,325,393 | B1 | | 12/2001 | Chen et al. | 279/22 |
| 6,347,562 | B1 | * | 2/2002 | Gerber, Jr. | 81/25 |
| 6,375,398 | B1 | | 4/2002 | Gaudreau et al. | 409/232 |
| 6,644,702 | B2 | * | 11/2003 | Liou | 294/57 |
| 2001/0042964 | A1 | | 11/2001 | Bedi et al. | 279/30 |

FOREIGN PATENT DOCUMENTS

| | | | |
|---|---|---|---|
| DE | 342856 | 10/1912 | 279/30 |

* cited by examiner

*Primary Examiner*—David B. Thomas
(74) *Attorney, Agent, or Firm*—Alan D. Kamrath; Nikolai & Mersereau, P.A.

(57) ABSTRACT

A tool includes a tool bit, a handle and a locking device. The tool bit includes a working head formed at an end, an insert formed at an opposite end and at least one annular groove defined in the insert. The handle includes a grip formed at an end, a socket defining a cavity for receiving the insert of the tool bit and a joint via which the socket is connected with an opposite end of the handle. The locking device can lock the insert of the tool bit in a releasable manner. The locking device includes a tunnel defined in the joint so that an axis of the tunnel is parallel to that of the cavity. A latch defines at least one notch. The latch is movable in the tunnel between a locking position and a releasing position. The locking device includes at least one truncated conical hole through which the cavity is communicated with the tunnel. The at least one truncated conical hole includes a first end at the cavity and a second end at the tunnel. In the at least one truncated conical hole, the first end is smaller than the second end. At least one ball is trapped in the at least one truncated conical hole. The at least one ball is pushed partially into the at least one groove by means of the latch in the locking position. The at least one ball is allowed complete removal from the at least one groove in the releasing position.

6 Claims, 9 Drawing Sheets

COMBINATION OF TOOL BIT WITH HANDLE

CROSS-REFERENCE

The present application is a Continuation-In-Part application of U.S. patent application Ser. No. 09/941,991 filed Aug. 29, 2001, now U.S. Pat. No. 6,612,586 issued Sep. 2, 2001.

BACKGROUND OF INVENTION

1. Field of Invention

The present invention is related to a tool and more particularly to a tool including a tool bit and a handle engaged with the tool bit in a releasable manner.

2. Related Prior Art

A conventional hand tool includes a tool bit secured to or integrated with a handle. Therefore, a user has to carry many handles and corresponding tool bits if wanting to do various types of work. The handles are bulky and heavy to carry.

There have been devised various hand tools that each include a tool bit engaged with a handle in a releasable manner. Generally, such a tool bit includes an insert, and such a handle includes a socket for receiving the insert. A locking device is used to lock the insert in the socket.

The present invention is therefore intended to obviate or at least alleviate the problems encountered in prior art.

SUMMARY OF INVENTION

It is the primary objective of the present invention to provide a tool including a handle for connection with a tool bit in a releasable manner.

According to the present invention, a tool includes a tool bit, a handle and a locking device. The tool bit includes a working head formed at an end, an insert formed at an opposite end and at least one annular groove defined in the insert. The handle includes a grip formed at an end, a socket defining a cavity for receiving the insert of the tool bit and a joint via which the socket is connected with an opposite end of the handle. The locking device can lock the insert of the tool bit in a releasable manner.

The locking device includes a tunnel defined in the joint so that an axis of the tunnel is parallel to that of the cavity. A latch defines at least one notch. The latch is movable in the tunnel between a locking position and a releasing position. The locking device includes at least one truncated conical hole through which the cavity is communicated with the tunnel. The at least one truncated conical hole includes a first end at the cavity and a second end at the tunnel. In the at least one truncated conical hole, the first end is smaller than the second end. At least one ball is trapped in the at least one truncated conical hole. The at least one ball is pushed partially into the at least one groove by means of the latch in the locking position. The at least one ball is allowed complete removal from the at least one groove in the releasing position.

Other objects objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
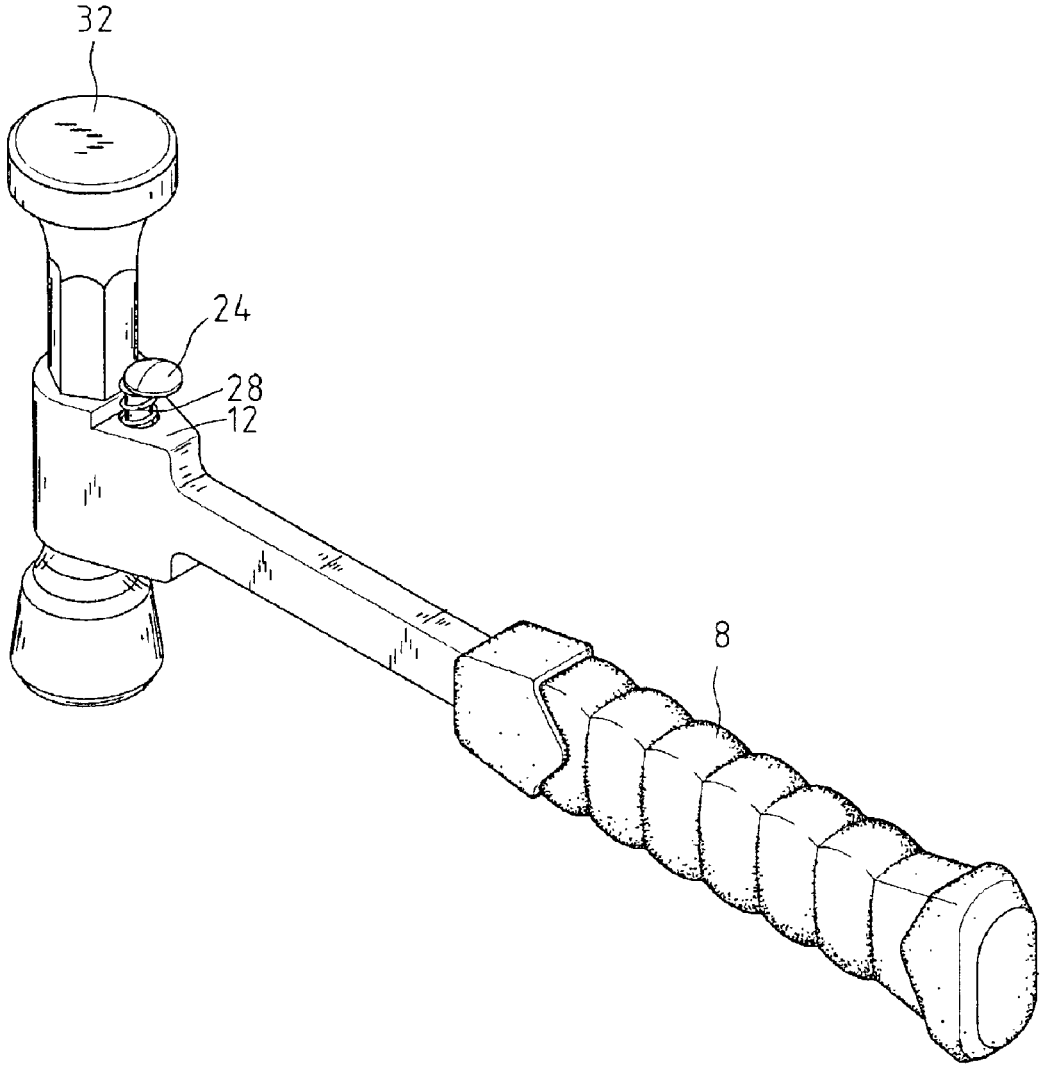
FIG. 1 is a perspective view of a tool including a tool bit engaged with a handle in a releasable manner according to the present invention.

Referring to FIG. 1, according to the preferred embodiment of the present invention, a tool 2 includes a tool bit 4 in the form of a hammer and a handle 6 engaged with the tool bit 4 in a releasable manner.

Figure 2:
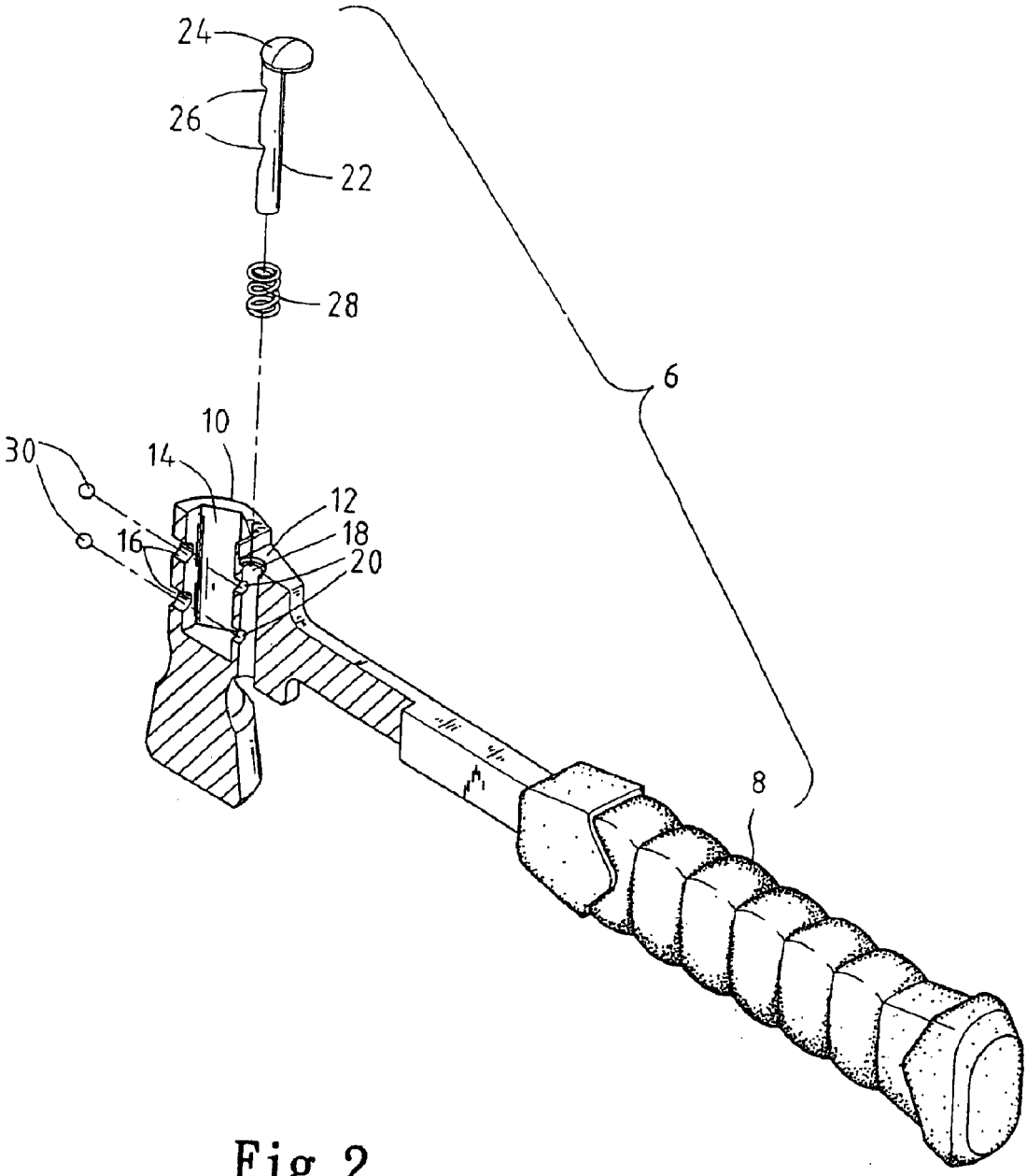
FIG. 2 is an exploded view of the handle shown in FIG. 1.

Referring to FIG. 2, the handle includes a grip 8 formed at an end, a socket 10 and a joint 12 formed between an opposite end and the socket 10. The socket 10 defines a cavity 14 for receiving the tool bit 4. As well known in the art, the cavity 14 is configured corresponding to the tool bit 4 in order to prevent rotation of the tool bit 4 in the cavity 14. Two cylindrical holes 16 are defined in the socket 10 so that they are in communication with the cavity 14. A tunnel 18 is defined in the joint 12 so that an axis thereof is parallel to that of the cavity 14. The tunnel 18 is in the form of a countersink hole, i.e., it includes a first portion section and a second section and an annular shoulder formed between the first and second sections. The cavity 14 is communicated with the tunnel 18 through two truncated conical holes 20. Each of the truncated conical holes 20 gets marginally larger from the cavity 14 to the tunnel 18, i.e., it includes a first end at the cavity 14 and a second end at the tunnel 18. In each of the truncated conical holes 20, the first end is smaller than the second end.

The handle 6 includes a latch 22. The latch 22 is in the form of a bolt including an end for insertion in the tunnel 18 and an opposite end formed with a head 24. Two notches 26 are defined in the latch 22.

In assembly, the latch 22 is inserted through a helical spring 28 into the tunnel 18 so that the truncated conical holes 20 are aligned with the notches 26. A ball 30 is located at the first end of each of the truncated conical holes 20. A proper tool (not shown) is inserted through each of the cylindrical holes 16 and through the cavity 14 so that it can be used to force each of the balls 30 through the first end of each of the truncated conical holes 20. Thus, each of the balls 30 is trapped in one of the truncated conical holes 20 and one of the notches 26.

Figure 3:
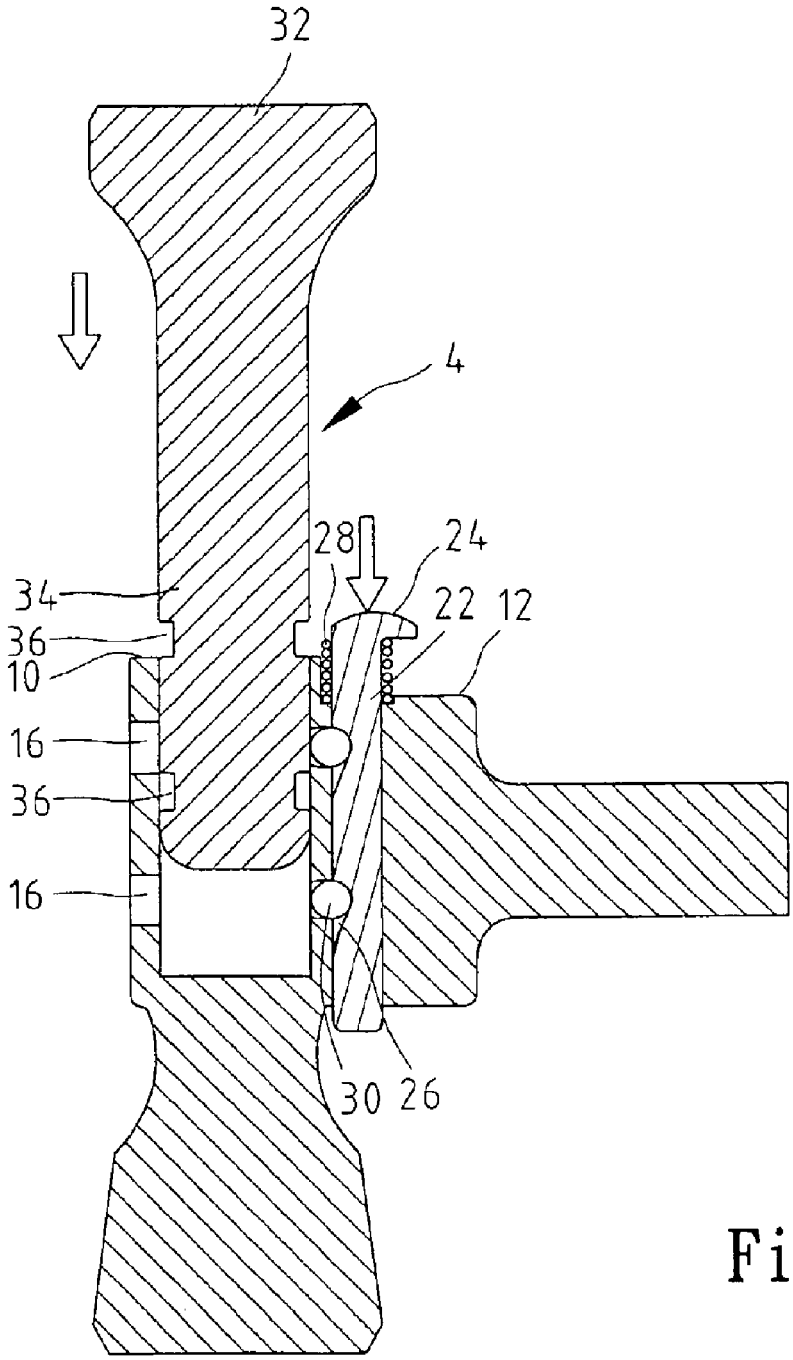
FIG. 3 is a cross-sectional view of the tool shown in FIG. 1, showing the tool bit being forced into engagement with the handle.

Referring to FIG. 3, the tool bit 4 includes a head 32 formed at an end for working and an insert 34 formed at an opposite end for insertion in the socket 10. Two annular grooves 36 are defined in the insert 34. The insert 34 is formed with a chamfered end 38.

When the insert 34 is forced into the socket 10, the chamfered end 38 thereof pushes a side of each of the balls 30 completely away from the cavities 14. An opposite side of each of the balls 30 pushes the face of each of the notches 26, thus causing the latch 22 to move downward.

Figure 4:
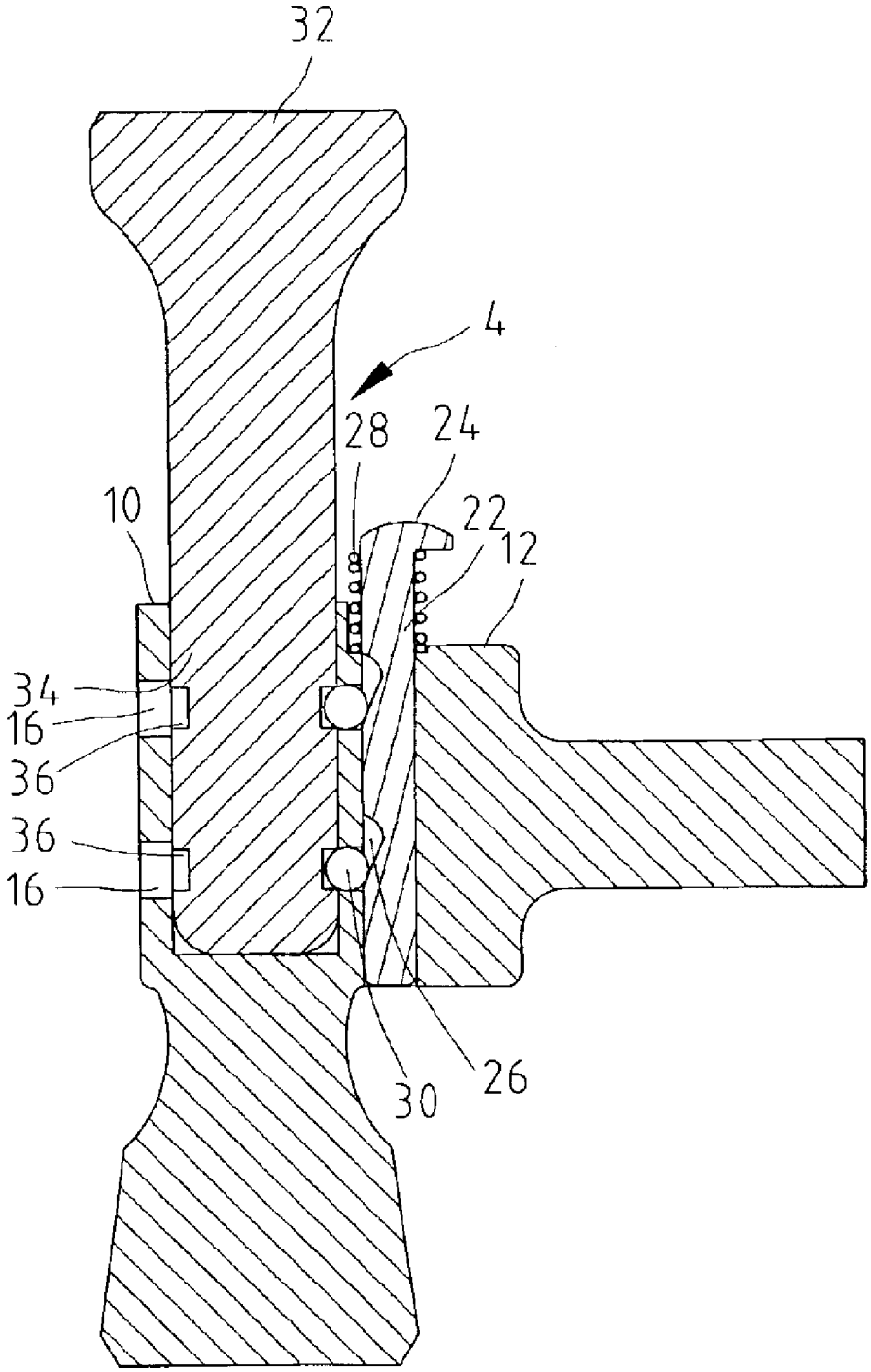
FIG. 4 is similar to FIG. 3, showing the handle in a locking position for locking the tool bit.

Referring to FIG. 4, when the insert 34 is inserted in the socket 10, the annular grooves 36 are aligned with the holes

20. The latch 22 is moved upward by means of the spring 28 compressed between the head 24 and the joint 12. The face of each of the notches 26 pushes one of the balls 30 on a side so that each of the balls 30 is inserted in one of the annular grooves 36 on an opposite side. Thus, the insert 34 is locked in the socket 10. That is, the tool bit 4 is engaged with the handle 6.

Figure 5:
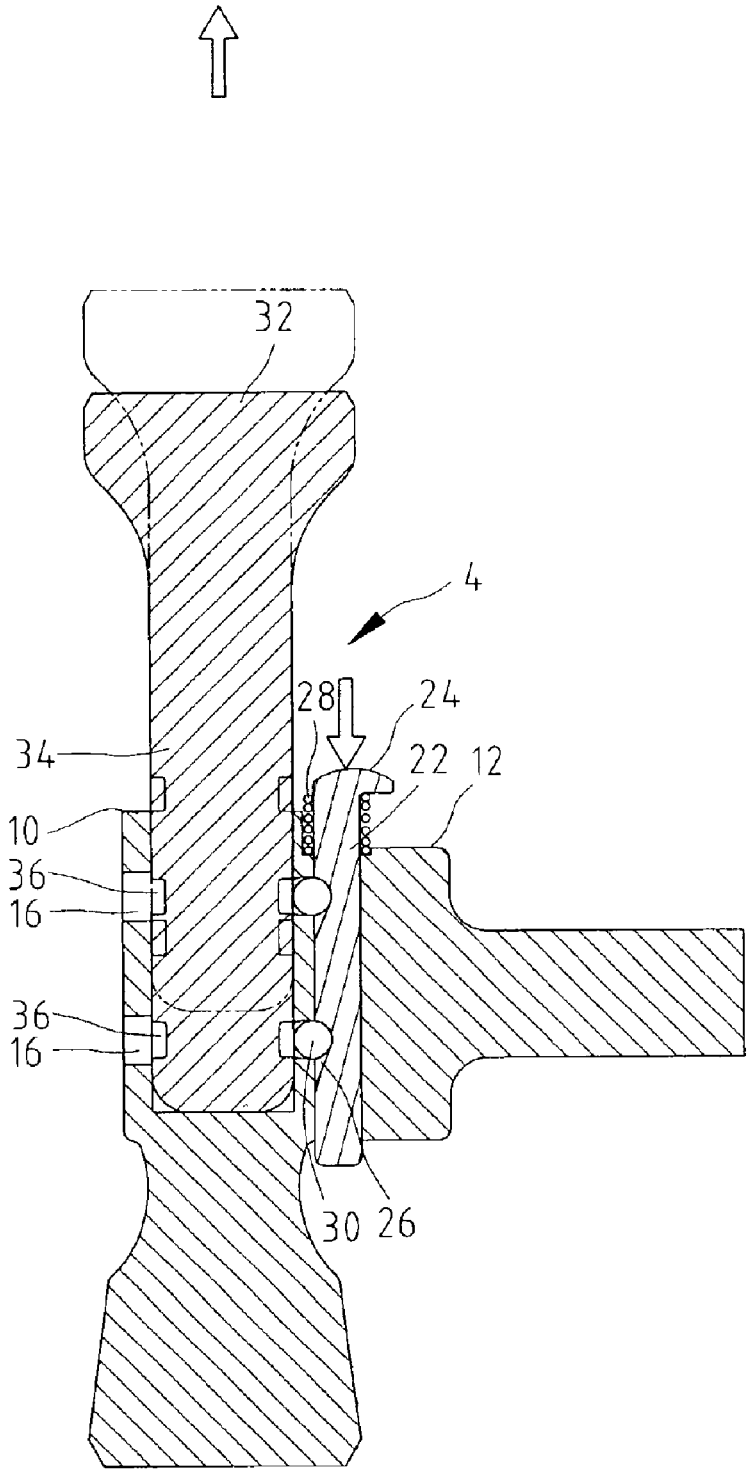
FIG. 5 is similar to FIG. 4, showing the handle in a releasing position for releasing the tool bit.
Figure 6:
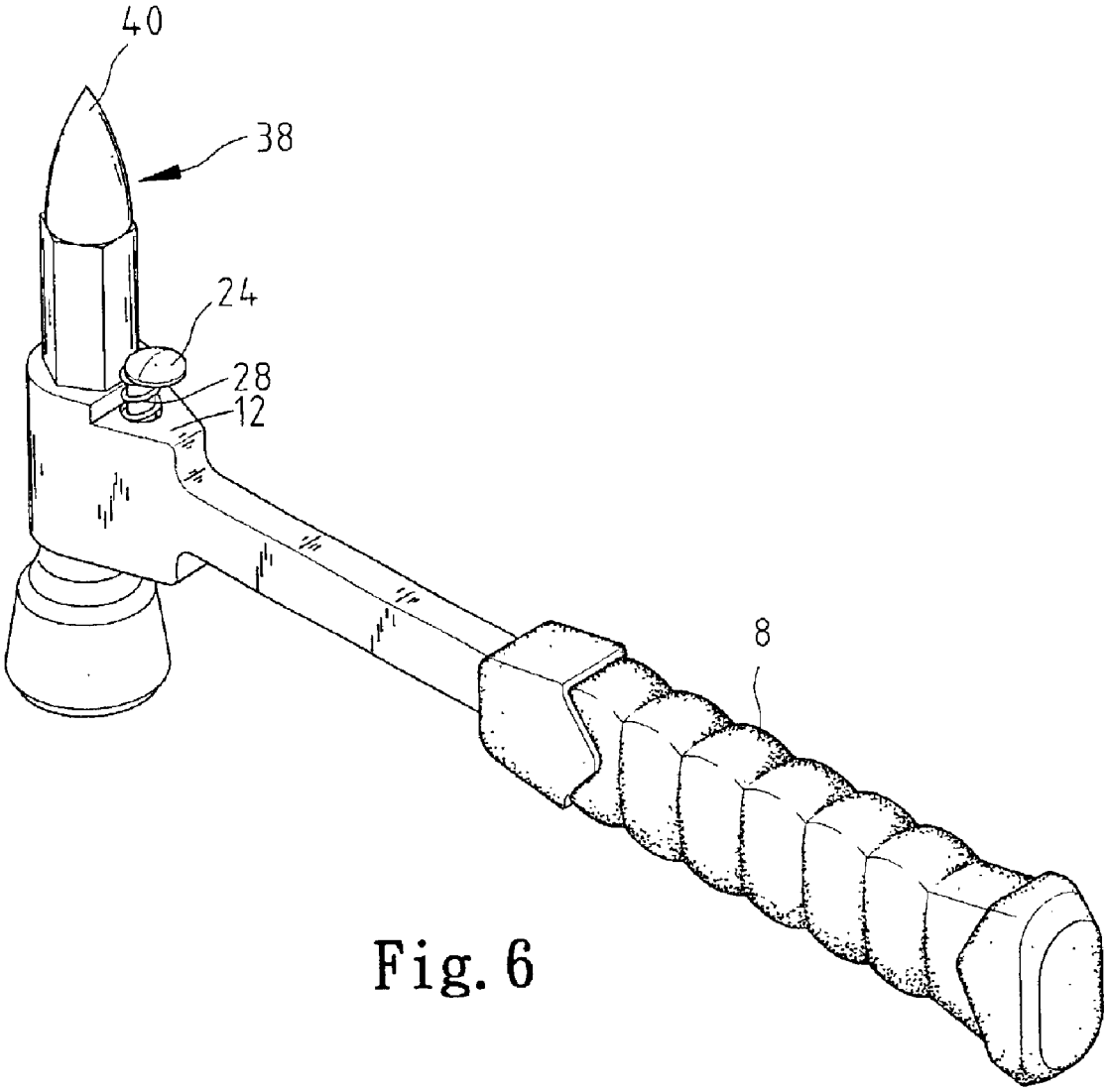
FIGS. 6–9 are perspective views of various tool bits engaged with the handle shown in FIG. 1.
Figure 7:
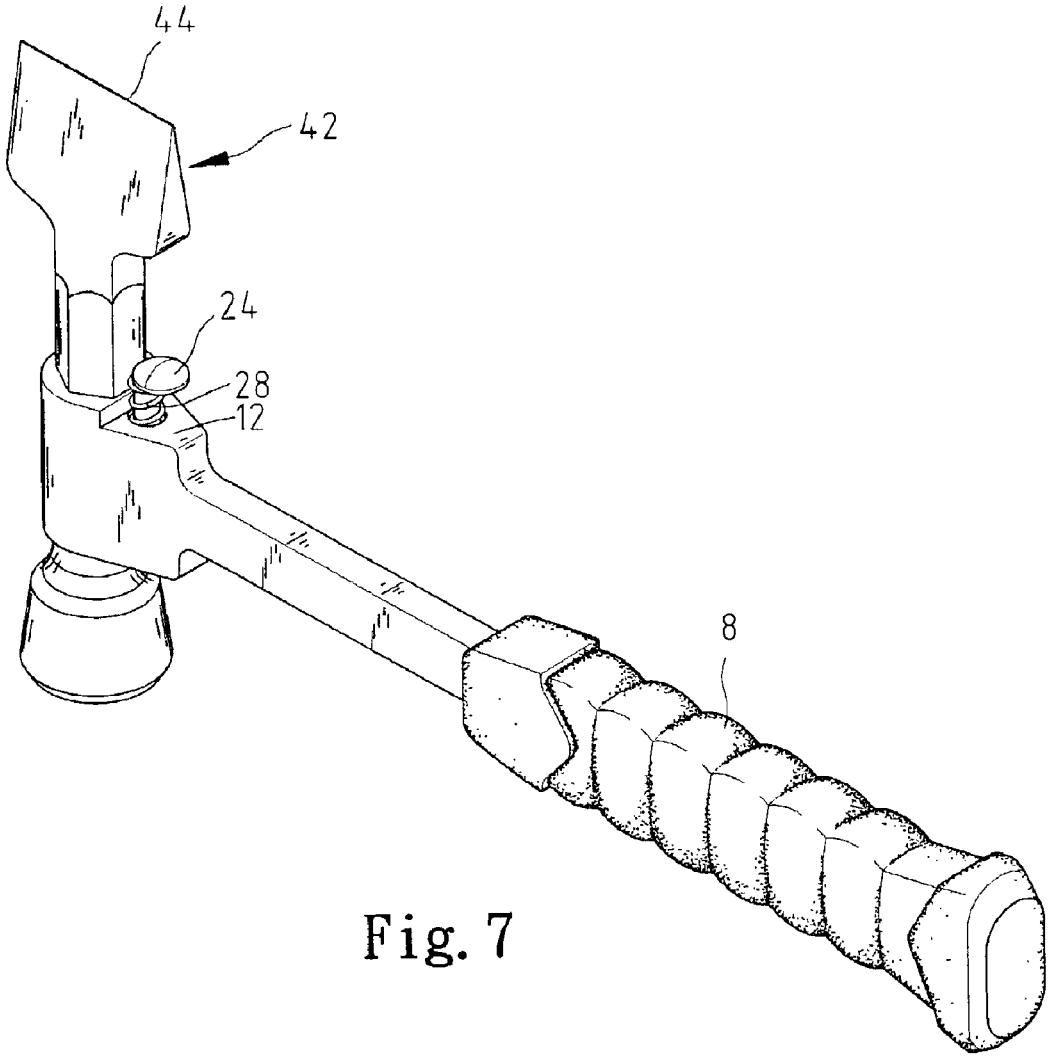
Figure 8:
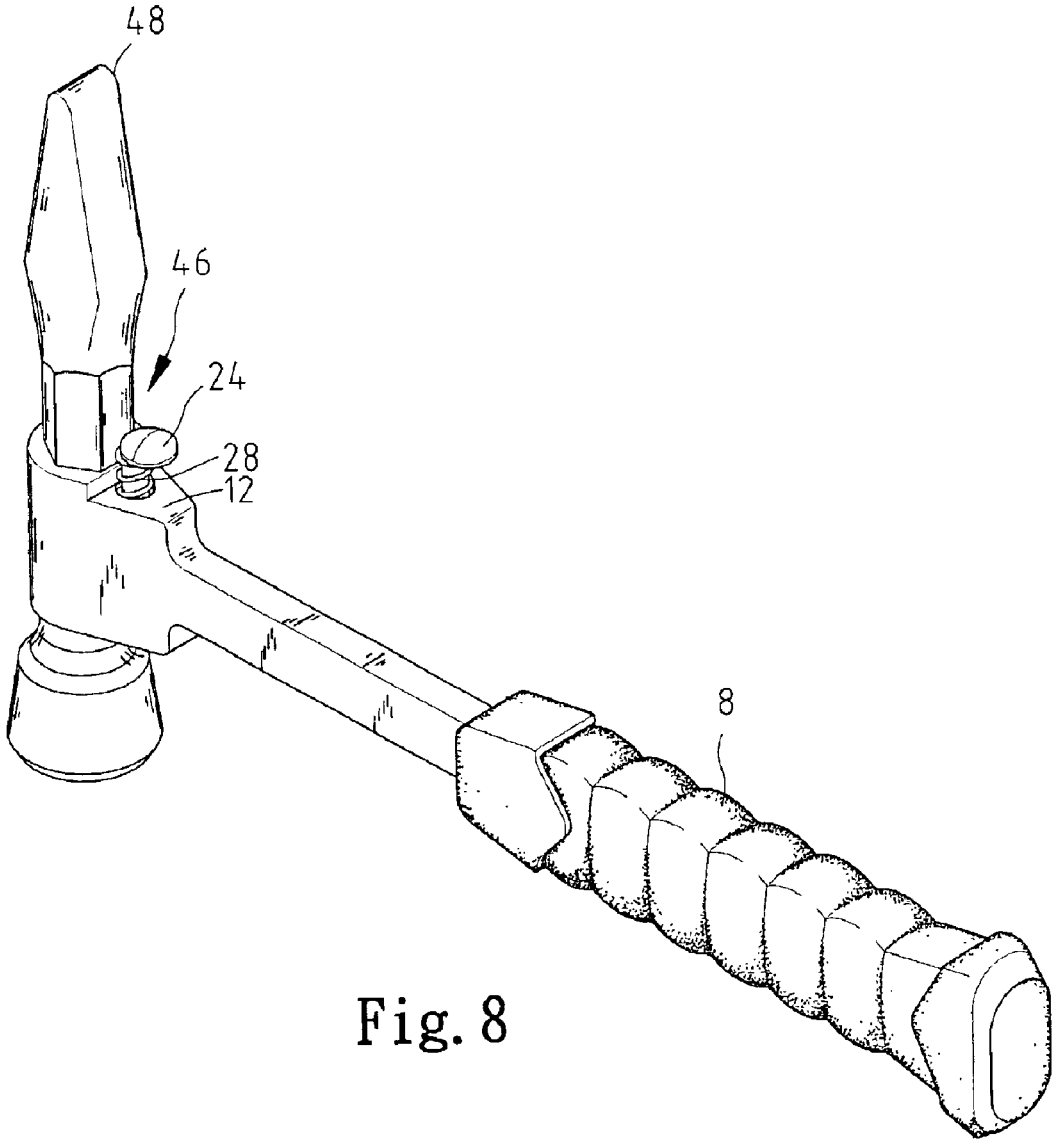
Figure 9:
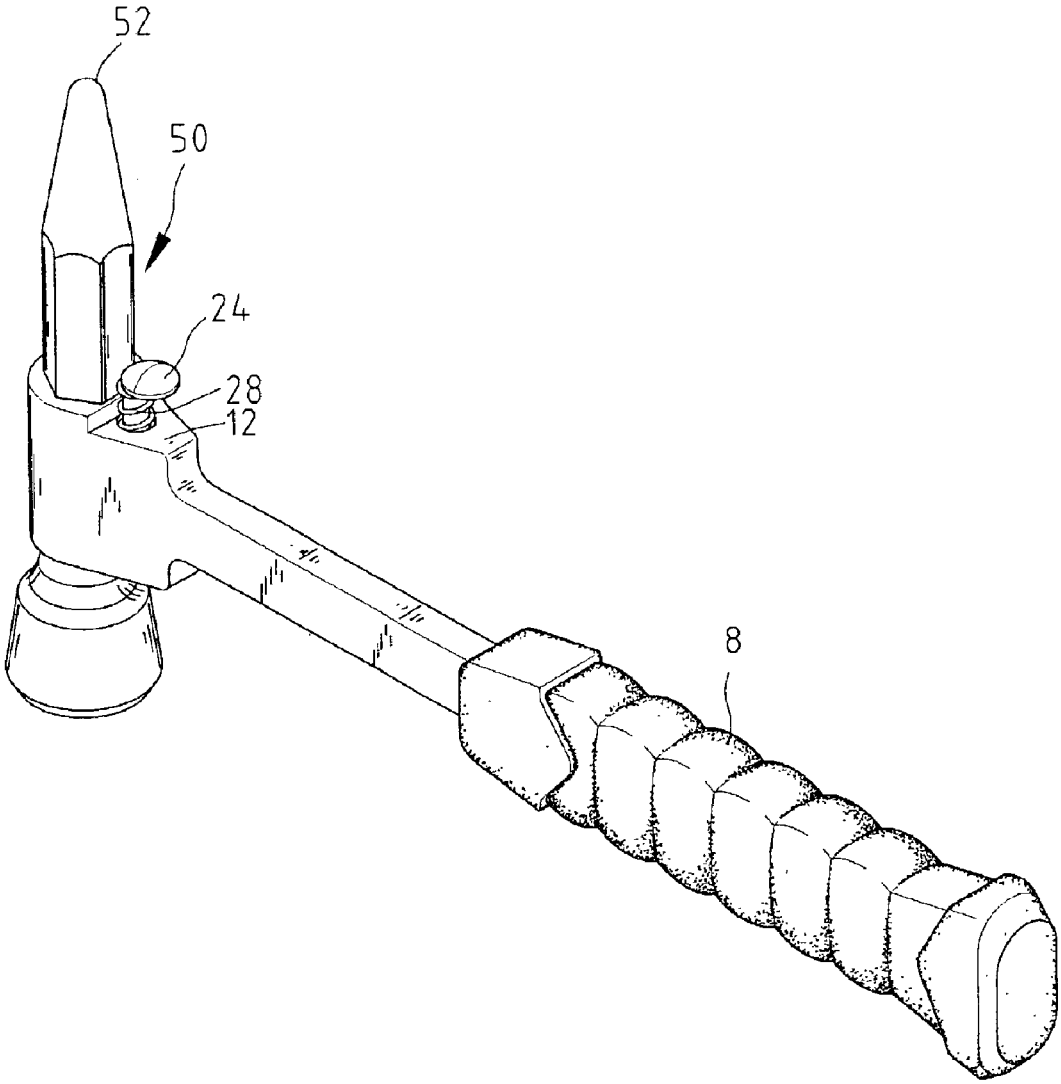

Referring to FIG. 5, the head 24 is pressed down. Thus, each of the notches 26 can receive a greater portion of each of the balls 30. That is, each of the balls 30 can be completely removed from one of the grooves 36. Thus, the insert 34 can be removed from the socket 10.

The tool bit 4 shown in FIG. 5 can be replaced with tool bits 38, 42, 46 and 50 shown in FIGS. 6 through 9, respectively. The tool bits 4, 38, 42, 46 and 50 are identical to one another except for including different working heads 32, 40, 44, 48 and 52, respectively. That is, all of the tool bits 4, 38, 42, 46 and 50 include a same insert 34 for insertion in the socket 10.

The preferred embodiments of the present invention have been described in detail for illustration of the present invention. Those skilled in the art can derive a lot of variations from these embodiments. Therefore, these embodiments shall not limit the scope of the present invention that can only be defined in the attached claims.

What is claimed is:

1. A tool including:

a tool bit including a working head formed at an end, an insert formed at an opposite end and at least one annular groove defined in the insert;

a handle including a grip formed at an end, a socket defining a cavity for receiving the insert and a joint via which the socket is connected with an opposite end of the handle; and a locking device for locking the insert in a releasable manner, wherein the locking device includes:

a tunnel defined in the joint so that an axis of the tunnel is parallel to that of the cavity;

a latch defining at least one notch, the latch being movable in the tunnel between a locking position and a releasing position;

at least one truncated conical hole through which the cavity is communicated with the tunnel, the at least one truncated conical hole including a first end at the cavity and a second end at the tunnel, the first end thereof being smaller than the second end thereof; and at least one ball trapped in the at least one truncated conical hole, wherein the at least one ball is pushed partially into the at least one groove by means of the latch in the locking position and is allowed complete removal from the at least one groove in the releasing position, wherein the insert defines two annular grooves, and the locking device includes two balls and two truncated conical holes corresponding to the grooves, and the latch defines two notches corresponding to the truncated conical holes.

2. The tool according to claim 1 wherein the latch includes a head, and the locking device includes a spring compressed between the joint and the head of the latch for pushing the latch to the locking position.

3. The tool according to claim 1 wherein the socket defines at least one cylindrical hole communicated with the cavity, a tool can be inserted through the cylindrical hole in order to force the at least one ball into the at least one truncated conical hole through the first end.

4. The tool according to claim 1 wherein the socket defines two cylindrical holes communicated with the cavity, a tool can be inserted through each of the cylindrical holes in order to force each of the balls into one of the truncated conical holes through the first end.

5. The tool according to claim 1 wherein the tool bit is a hammer.

6. The tool according to claim 1 wherein the tool bit is a chisel.

* * * * *